US007987551B2

(12) United States Patent
Hwang et al.

(10) Patent No.: US 7,987,551 B2
(45) Date of Patent: Aug. 2, 2011

(54) VACUUM CLEANER

(75) Inventors: Man Tae Hwang, Changwon-si (KR); Hae Seock Yang, Changwon-si (KR); Hoi Kil Jeong, Changwon-si (KR); Myung Sig Yoo, Changwon-si (KR); Jae Kyum Kim, Kimhae-si (KR); Moo Hyun Ko, Moonkyung-si (KR); Kie Tak Hyun, Changwon-si (KR); Jong Su Choo, Busan-si (KR); Young Bok Son, Changwon-si (KR); Kyeong Seon Jeong, Changwon-si (KR); Min Park, Busan-si (KR); Sung Hwa Lee, Changwon-si (KR); Il Joong Kim, Masan-si (KR); Jin Hyouk Shin, Busan-si (KR); Gun Ho Ha, Busan-Si (KR); Jin Wook Seo, Busan-si (KR); Chang Ho Yun, Changwon-si (KR); Jin Young Kim, Busan-si (KR); Chang Hoon Lee, Kyungsangnam-do (KR); Yun Hee Park, Kimhae-si (KR); Hyuk-Min Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/408,066

(22) Filed: Mar. 20, 2009

(65) Prior Publication Data

US 2009/0255083 A1 Oct. 15, 2009

Related U.S. Application Data

(63) Continuation-in-part of application No. 11/565,241, filed on Nov. 30, 2006, now Pat. No. 7,749,295, which is a continuation-in-part of application No. 11/565,206, filed on Nov. 30, 2006, now Pat. No. 7,882,592.

(30) Foreign Application Priority Data

| | | |
|---|---|---|
| Dec. 20, 2005 | (KR) | 2005-0121279 |
| Dec. 20, 2005 | (KR) | 2005-0126270 |
| Dec. 29, 2005 | (KR) | 2005-0134094 |
| Feb. 24, 2006 | (KR) | 2006-0018119 |
| Feb. 24, 2006 | (KR) | 2006-0018120 |
| May 3, 2006 | (KR) | 2006-0040106 |
| May 17, 2006 | (KR) | 2006-0044359 |
| May 17, 2006 | (KR) | 2006-0044362 |
| May 20, 2006 | (KR) | 2006-0045415 |
| May 20, 2006 | (KR) | 2006-0045416 |
| May 23, 2006 | (KR) | 2006-0046077 |
| Sep. 6, 2006 | (KR) | 2006-0085919 |
| Sep. 6, 2006 | (KR) | 2006-0085921 |
| Oct. 10, 2006 | (KR) | 2006-0098191 |
| Jul. 8, 2008 | (KR) | 10-2008-0065806 |
| Jul. 8, 2008 | (KR) | 10-2008-0065807 |

(51) Int. Cl.
*A47L 9/00* (2006.01)

(52) U.S. Cl. ..... 15/347; 15/352

(58) Field of Classification Search ..... 15/347, 15/327.1, 352, 353
See application file for complete search history.

(56) References Cited

U.S. PATENT DOCUMENTS 83,469 A 10/1868 Crandall (Continued)

FOREIGN PATENT DOCUMENTS

AU 2005229774 8/2006

(Continued)

OTHER PUBLICATIONS

Russian Office Action dated Oct. 4, 2007 (2007103555) (translation).

(Continued)

*Primary Examiner* — Dung Van Nguyen
(74) *Attorney, Agent, or Firm* — KED & Associates LLP

(57) ABSTRACT

A vacuum cleaner is provided. The vacuum cleaner may include a dust collection container that stores dust, a compression member that is provided in the dust collection container and which is capable of rotating in first and second directions, and a driver that rotates the compression member. The compression member rotates in a first space corresponding to a first angle range and at least a portion of the dust is stored in a second space corresponding to a second angle range.

17 Claims, 10 Drawing Sheets

U.S. PATENT DOCUMENTS

| | | | |
|---|---|---|---|
| 2,283,836 | A | 5/1942 | White |
| 2,714,426 | A | 8/1955 | White |
| 3,367,462 | A | 2/1968 | Bibbens |
| 4,379,385 | A | 4/1983 | Reinhall |
| 4,545,794 | A | 10/1985 | Himukai |
| 4,601,082 | A | 7/1986 | Kurz |
| 4,617,034 | A | 10/1986 | Ikezaki et al. |
| 4,809,394 | A | 3/1989 | Suka et al. |
| 5,033,151 | A | 7/1991 | Kraft et al. |
| 5,135,552 | A | 8/1992 | Weistra |
| 5,159,738 | A | 11/1992 | Sunagawa et al. |
| 5,233,682 | A | 8/1993 | Abe et al. |
| 5,251,358 | A | 10/1993 | Moro et al. |
| 5,265,305 | A | 11/1993 | Kraft et al. |
| 5,323,483 | A | 6/1994 | Baeg |
| 5,542,146 | A | 8/1996 | Hoekstra et al. |
| 6,460,217 | B2 | 10/2002 | Fukushima et al. |
| 6,625,845 | B2 | 9/2003 | Matsumoto et al. |
| 6,689,225 | B2 | 2/2004 | Illingworth |
| 6,694,917 | B1 | 2/2004 | Wang |
| 6,735,816 | B2 | 5/2004 | Oh et al. |
| 6,757,933 | B2 | 7/2004 | Oh et al. |
| 6,779,229 | B2 | 8/2004 | Lee et al. |
| 6,782,584 | B2 | 8/2004 | Choi |
| 6,922,868 | B1 | 8/2005 | Jeong |
| 7,028,369 | B2 | 4/2006 | Park et al. |
| 7,152,276 | B2 | 12/2006 | Jin et al. |
| 7,351,269 | B2 | 4/2008 | Yau |
| 7,475,449 | B2 | 1/2009 | Lee |
| 7,481,868 | B2 | 1/2009 | Lee et al. |
| 7,547,340 | B2 | 6/2009 | Park |
| 7,582,128 | B2 | 9/2009 | Hwang et al. |
| 7,601,188 | B2 | 10/2009 | Hwang et al. |
| 7,608,123 | B2 | 10/2009 | Pineschi |
| 7,640,625 | B2 | 1/2010 | Oh et al. |
| 7,644,469 | B2 | 1/2010 | Beers et al. |
| 7,647,672 | B2 | 1/2010 | Nam et al. |
| 7,704,290 | B2 | 4/2010 | Oh |
| 7,749,295 | B2 | 7/2010 | Hwang et al. |
| 7,770,253 | B2 | 8/2010 | Ha et al. |
| 7,785,381 | B2 | 8/2010 | Oh et al. |
| 7,785,396 | B2 | 8/2010 | Hwang et al. |
| 7,854,782 | B2 | 12/2010 | Oh et al. |
| 2001/0025395 | A1 | 10/2001 | Matsumoto et al. |
| 2002/0073505 | A1 | 6/2002 | Bolden |
| 2002/0088079 | A1 | 7/2002 | Oh |
| 2002/0124538 | A1 | 9/2002 | Oh et al. |
| 2004/0211025 | A1 | 10/2004 | Jung et al. |
| 2004/0261216 | A1 | 12/2004 | Choi et al. |
| 2005/0091787 | A1 | 5/2005 | Bair et al. |
| 2005/0138763 | A1 | 6/2005 | Tanner et al. |
| 2005/0172584 | A1 | 8/2005 | Oh et al. |
| 2005/0252179 | A1 | 11/2005 | Oh et al. |
| 2006/0123750 | A1 | 6/2006 | Lee et al. |
| 2006/0230722 | A1 | 10/2006 | Oh et al. |
| 2007/0136980 | A1 | 6/2007 | Fujiwara et al. |
| 2007/0143953 | A1 | 6/2007 | Hwang et al. |
| 2007/0209149 | A1 | 9/2007 | Lee |
| 2007/0209339 | A1 | 9/2007 | Conrad |
| 2008/0023035 | A1 | 1/2008 | Ha et al. |
| 2008/0023036 | A1 | 1/2008 | Ha et al. |
| 2008/0047094 | A1 | 2/2008 | Ha et al. |
| 2008/0052870 | A1 | 3/2008 | Lee et al. |
| 2008/0172824 | A1 | 7/2008 | Yun et al. |
| 2008/0172993 | A1 | 7/2008 | Yun et al. |
| 2008/0263816 | A1 | 10/2008 | Oh et al. |
| 2008/0264007 | A1 | 10/2008 | Oh et al. |
| 2008/0264014 | A1 | 10/2008 | Oh et al. |
| 2008/0264015 | A1 | 10/2008 | Oh et al. |
| 2008/0264016 | A1 | 10/2008 | Oh et al. |
| 2009/0178231 | A1 | 7/2009 | Hwang et al. |
| 2009/0178235 | A1 | 7/2009 | Yun et al. |
| 2009/0178236 | A1 | 7/2009 | Yun et al. |
| 2009/0229072 | A1 | 9/2009 | Hwang et al. |
| 2009/0229073 | A1 | 9/2009 | Hwang et al. |
| 2009/0235956 | A1 | 9/2009 | Hwang et al. |
| 2009/0241286 | A1 | 10/2009 | Hwang et al. |
| 2009/0249578 | A1 | 10/2009 | Hwang et al. |
| 2009/0255083 | A1 | 10/2009 | Hwang et al. |
| 2009/0266382 | A1 | 10/2009 | Hwang et al. |
| 2009/0293221 | A1 | 12/2009 | Hwang et al. |
| 2009/0293223 | A1 | 12/2009 | Hwang et al. |
| 2009/0293224 | A1 | 12/2009 | Hyun et al. |
| 2009/0293915 | A1 | 12/2009 | Hwang et al. |

FOREIGN PATENT DOCUMENTS

| | | | |
|---|---|---|---|
| AU | 2007200406 | B2 | 9/2007 |
| CN | 2162679 | | 4/1994 |
| CN | 2186039 | | 12/1994 |
| CN | 2409894 | | 12/2000 |
| CN | 1334061 | | 2/2002 |
| CN | 1434749 | A | 8/2003 |
| CN | 1593324 | | 3/2005 |
| CN | 1695537 | | 11/2005 |
| CN | 1695538 | | 11/2005 |
| CN | 1777385 | | 5/2006 |
| CN | 1778246 | | 5/2006 |
| DE | 102 40 618 | | 9/2003 |
| EP | 1 371 318 | A2 | 12/2003 |
| EP | 1 671 570 | | 6/2006 |
| EP | 01 136 028 | | 7/2006 |
| EP | 1 733 669 | | 12/2006 |
| EP | 1857032 | A2 * | 11/2007 |
| FR | 2 823 091 | | 10/2002 |
| GB | 2 368 516 | | 5/2002 |
| GB | 2 377 881 | | 1/2003 |
| GB | 2 388 769 | | 4/2004 |
| GB | 2404887 | | 2/2005 |
| GB | 2 406 064 | | 3/2005 |
| GB | 2416721 | | 2/2006 |
| JP | 1972-14759 | | 8/1972 |
| JP | 50-022355 | | 3/1975 |
| JP | 53-051663 | | 5/1978 |
| JP | 54-28457 | | 3/1979 |
| JP | 54-51259 | | 4/1979 |
| JP | 54-085560 | | 7/1979 |
| JP | 54-085561 | | 7/1979 |
| JP | 54-119272 | | 8/1979 |
| JP | 54-114358 | | 9/1979 |
| JP | 54-114366 | | 9/1979 |
| JP | 54-114367 | | 9/1979 |
| JP | 54161751 | | 12/1979 |
| JP | 55-74553 | | 6/1980 |
| JP | 56-26044 | | 3/1981 |
| JP | 58-84066 | A | 5/1983 |
| JP | 58-175532 | | 10/1983 |
| JP | 58-218934 | | 12/1983 |
| JP | 59-125354 | | 8/1984 |
| JP | 64-029246 | | 1/1989 |
| JP | 02-007927 | | 1/1990 |
| JP | 4-116933 | U | 10/1992 |
| JP | 06-054778 | | 3/1994 |
| JP | 7-241265 | | 9/1995 |
| JP | 07-313412 | | 12/1995 |
| JP | 408000514 | | 1/1996 |
| JP | 08-112223 | A | 5/1996 |
| JP | 08-140907 | | 6/1996 |
| JP | 10-243900 | | 9/1998 |
| JP | 11-004789 | | 1/1999 |
| JP | 2000-262449 | | 9/2000 |
| JP | 2002-143060 | | 5/2002 |
| JP | 2002-187336 | | 7/2002 |
| JP | 2002-360474 | | 12/2002 |
| JP | 2003-019097 | | 1/2003 |
| JP | 2003-119575 | | 4/2003 |
| JP | 2003-125995 | | 5/2003 |
| JP | 2003-190056 | A | 7/2003 |
| JP | 2003-199695 | | 7/2003 |
| JP | 2003-310502 | | 11/2003 |
| JP | 2003-310506 | A | 11/2003 |
| JP | 2004-065357 | | 3/2004 |
| JP | 2004-528087 | A | 9/2004 |
| JP | 2004-528876 | | 9/2004 |
| JP | 2005-34213 | | 2/2005 |
| JP | 2005-324002 | | 11/2005 |
| JP | 06-061439 | | 3/2006 |
| JP | 2006-068500 | | 3/2006 |

| | | | |
|---|---|---|---|
| JP | 3119575 | | 3/2006 |
| JP | 2007-007381 | A | 1/2007 |
| JP | 2008-73066 | | 4/2008 |
| JP | 2003-524522 | | 8/2008 |
| KR | 1993-0008369 | | 8/1993 |
| KR | 2002-0091510 | | 12/2002 |
| KR | 10-2005-0005611 | | 1/2005 |
| KR | 10-2005-013694 | | 2/2005 |
| KR | 10-0546629 | B1 | 1/2006 |
| KR | 10-0553042 | B1 | 2/2006 |
| KR | 10-2006-031442 | | 4/2006 |
| KR | 2006-0116992 | | 11/2006 |
| KR | 10-0730956 | | 6/2007 |
| KR | 10-2007-084834 | | 8/2007 |
| KR | 10-2007-088022 | | 8/2007 |
| KR | 10-0800188 | | 1/2008 |
| KR | 10-0800189 | | 1/2008 |
| KR | 10-0838886 | | 6/2008 |
| KR | 10-0838887 | | 6/2008 |
| RU | 2172132 | | 8/2001 |
| RU | 2 243 714 | | 1/2005 |
| RU | 2 269 919 | | 9/2005 |
| SU | 1326236 | | 7/1987 |
| WO | WO 00/74548 | | 12/2000 |
| WO | WO/01/35809 | | 5/2001 |
| WO | WO 01/60524 | | 8/2001 |
| WO | WO 2004/064591 | | 8/2004 |
| WO | WO2005099545 | | 10/2005 |

OTHER PUBLICATIONS

Russian Office Action dated Oct. 12, 2007 (2007103557).
Korean Office Action dated Mar. 25, 2008 (016285635).
Australian Office Action dated Apr. 15, 2008 (2007200407).
Australian Office Action dated Apr. 24, 2008 (2007200409).
European Office Action dated May 8, 2008 (07101388.2-2316).
Korean Office Action dated Sep. 30, 2008 (050567614).
Chinese Office Action dated Dec. 12, 2008 (200710002992.1) (translation).
U.S. Office Action dated May 13, 2009 (U.S. Appl. No. 11/965,133).
Chinese Office Action dated May 22, 2009 (200710002992.1) (translation).
Japanese Office Action dated Jul. 28, 2009 (2007-066748).
Chinese Office Action dated Aug. 21, 2009 (200710002991.7) (translation).
U.S. Office Action dated Sep. 10, 2009 (U.S. Appl. No. 11/565,241).
U.S. Office Action dated Oct. 6, 2009 (U.S. Appl. No. 12/406,803).
European Search Report dated Oct. 15, 2009. (0162556.0-2316).
Japanese Office Action dated Nov. 4, 2009. (2007-019770).
Chinese Office Action dated Nov. 13, 2009 (200710085701.X) (translation).
Canadian Office Action dated Nov. 18, 2009 (2) (50514-26) (50514-27).
Japanese Office Action dated Nov. 25, 2009 (2007-019861).
Chinese Office Action dated Dec. 11, 2009 (200710002992.1).
Notice of Allowance dated Jan. 13, 2010 (U.S. Appl. No. 11/965,133).
Notice of Allowance dated Feb. 19, 2010 (U.S. Appl. No. 11/565,241).
Notice of Allowance dated Feb. 24, 2010 (U.S. Appl. No. 11/831,564).
European Search Report dated Jan. 20, 2010.
Chinese Office Action dated Feb. 5, 2010. (with translation).
U.S. Appl. No. 11/965,133 Notice of Allowance dated Jan. 13, 2010.
U.S. Appl. No. 11/565,241 Notice of Allowance dated Feb. 19, 2010.
U.S. Appl. No. 11/831,564 Notice of Allowance dated Feb. 24, 2010.
Korean Office Action dated Mar. 18, 2010.
Korean Office Action dated Mar. 25, 2010.
U.S. Office Action U.S. Appl. No. 11/565,206 dated Apr. 19, 2010.
U.S. Notice of Allowance U.S. Appl. No. 11/831,519 dated Apr. 21, 2010.
Korean Office Action dated Aug. 29, 2008.
Japanese Office Action dated Sep. 18, 2008.
International Search Report and Written Opinion dated Dec. 10, 2008.
Japanese Office Action dated Dec. 24, 2008.
Chinese Office Action dated Feb. 6, 2009.
Japanese Office Action dated Mar. 12, 2009.
Japanese Office Action dated Mar. 13, 2009.
Chinese Office Action dated Apr. 3, 2009 (translation).
Chinese Office Action dated May 8, 2009 (translation).
Japanese Office Action dated May 22, 2009.
Chinese Office Action dated Jun. 5, 2009 (translation).
European Search Report dated Jun. 16, 2009 (in English).
Korean Office Action dated Jun. 19, 2009.
Chinese Office Action dated Jul. 3, 2009 (with translation).
Japanese Office Action dated Jul. 28, 2009 (with translation).
U.S. Office Action dated Feb. 11, 2008 (U.S. Appl. No. 11/831,473).
U.S. Office Action dated Feb. 11, 2008 (U.S. Appl. No. 11/831,564).
U.S. Office Action dated Jul. 24, 2008 (U.S. Appl. No. 11/831,473).
U.S. Office Action dated Jul. 28, 2008 (U.S. Appl. No. 11/712,958).
U.S. Office Action dated Aug. 28, 2008 (U.S. Appl. No. 11/713,022).
U.S. Office Action dated Sep. 19, 2008 (U.S. Appl. No. 11/831,564).
U.S. Office Action dated Oct. 20, 2008 (U.S. Appl. No. 11/831,473).
U.S. Office Action dated Mar. 9, 2009 (U.S. Appl. No. 11/713,022).
U.S. Office Action dated May 28, 2009 (U.S. Appl. No. 11/831,473).
U.S. Office Action dated Sep. 3, 2009 (U.S. Appl. No. 11/831,564).
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
Japanese Office Action dated May 13, 2010.
U.S. Office Action U.S. Appl. No. 11/831,473 dated May 14, 2010.
U.S. Office Action U.S. Appl. No. 12/406,803 dated May 26, 2010.
U.S. Office Action U.S. Appl. No. 11/965,133 dated Jul. 9, 2010.
Canadian Office Action dated Jun. 30, 2010.
Japanese Office Action dated Aug. 3, 2010.
U.S. Office Action U.S. Appl. No. 12/406,779 dated Aug. 18, 2010.
U.S. Office Action U.S. Appl. No. 11/831,473 dated Sep. 1, 2010.
Russian Office Action dated Sep. 28, 2007 issued in Application No. 2007103559 (translation only).
Australian Office Action dated Apr. 17, 2008 issued in Application No. 2007200408.
Russian Office Action dated Apr. 21, 2008 issued in Application No. 2007103560 (with translation).
Australian Office Action dated Jun. 3, 2008 issued in Application No. 2006249267.
Japanese Office Action dated Nov. 6, 2008 issued in Application No. 2006-333685.
Russian Office Action dated Mar. 25, 2009 issued in Application No. 2008102660 (with translation).
Australian Office Action dated Apr. 16, 2009 issued in Application No. 2008200340.
Chinese Office Action dated Aug. 21, 2009 issued in Application No. 200810008716.0 (with translation).
Japanese Office Action dated Nov. 25, 2009 issued in Application No. 2007-021083.
Japanese Office Action dated Nov. 25, 2009 issued in Application No. 2007-066748.
Korean Office Action dated Sep. 17, 2010 issued in Application No. 10-2008-0065806.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/710,585 dated Feb. 10, 2011.
U.S. Office Action issued in U.S. Appl. No. 12/404,739 dated Feb. 18, 2011.

U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6- 2316/1852048).
Russian Office Action dated Feb. 2, 2011 (Application No. 2009143355) (with translation).
Japanese Office Action dated Apr. 7, 2011. (2010-005365).

* cited by examiner

VACUUM CLEANER

This application is a Continuation in Part of 1) U.S. patent application Ser. No. 11/565,241, filed Nov. 30, 2006 now U.S. Pat. No. 7,749,295, which is a Continuation in Part of U.S. patent application Ser. No. 11/565,206, filed Nov. 30, 2006 now U.S. Pat. No. 7,882,592, which claims priority to Korean Patent Application Nos. 2005-0121279 filed in Korea on Dec. 20, 2005, 2005-0126270 filed in Korea on Dec. 20, 2005, 2005-0134094 filed in Korea on Dec. 29, 2005, 2006-0018119 filed in Korea on Feb. 24, 2006, 2006-0018120 filed in Korea on Feb. 24, 2006, 2006-0040106 filed in Korea on May 3, 2006, 2006-0045415 filed in Korea on May 20, 2006, 2006-0045416 filed in Korea on May 20, 2006, 2006-0046077 filed in Korea on May 23, 2006, 2006-0044359 filed in Korean on May 17, 2006, 2006-0044362 filed in Korea on May 17, 2006, 2006-0085919 filed in Korea on Sep. 6, 2006, 2006-0085921 filed in Korea on Sep. 6, 2006, and 2006-0098191 filed in Korea on Oct. 10, 2006 and 2) PCT application No. PCT/KR2008/004849, filed Aug. 20, 2008, which claims priority to Korean Patent Application No(s). 10-2008-0065806 and 10-2008-0065807 filed in Korea on Jul. 8, 2008.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
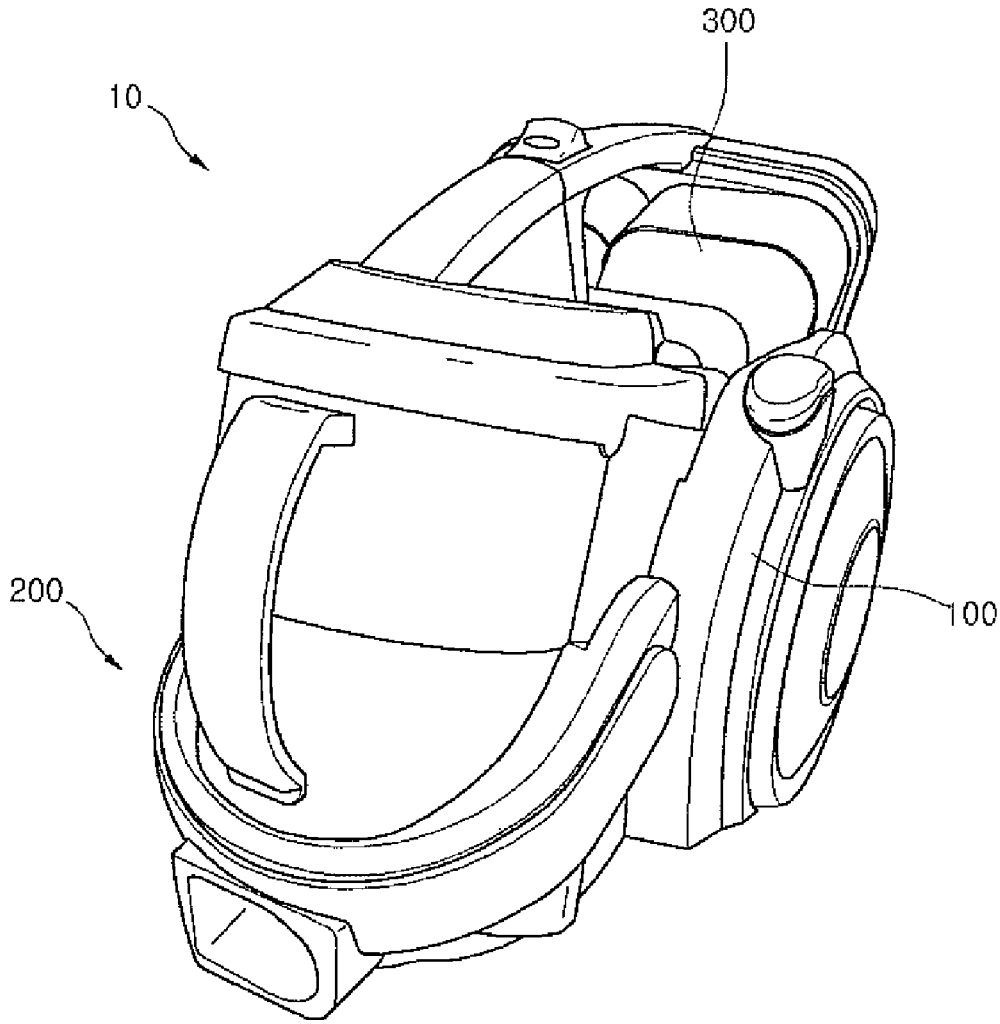
FIG. 1 is a front, perspective view of a vacuum cleaner according to an embodiment.

Reference will now be made in detail to embodiments, examples of which are illustrated in the accompanying drawings. Where possible, like reference numerals have been used to indicate like elements.

Generally, a vacuum cleaner is an electrically powered cleaning device that sucks air containing dust into a main body using suction generated by a suction motor, and that filters the dust in the main body. The vacuum cleaner may include a suction nozzle that sucks in the air containing the dust, a main body connected to the suction nozzle, and a dust collection device that separates the dust from the air sucked in through the suction nozzle and stores the dusts.

In more detail, the dust collection device may include a dust separating device that separates the dust from the air, and a dust collection container that defines a dust storing portion in which the dust separated in the dust separating device is stored. When the vacuum cleaner stops operating during a dust separation process in the dust collection device, the separated dust is stored in the dust collection device under a relatively low density state.

In related art dust collection devices, a space occupied by the dust stored in the dust collection device is too big in comparison to a weight of the dust. The dust collection device must be frequently emptied in order to maintain a proper dust collection performance. This is troublesome for the user. Therefore, in order to improve user convenience of the vacuum cleaner, a vacuum cleaner that can maximize the dust collection volume and improve the dust collection performance has been developed.

Figure 2:
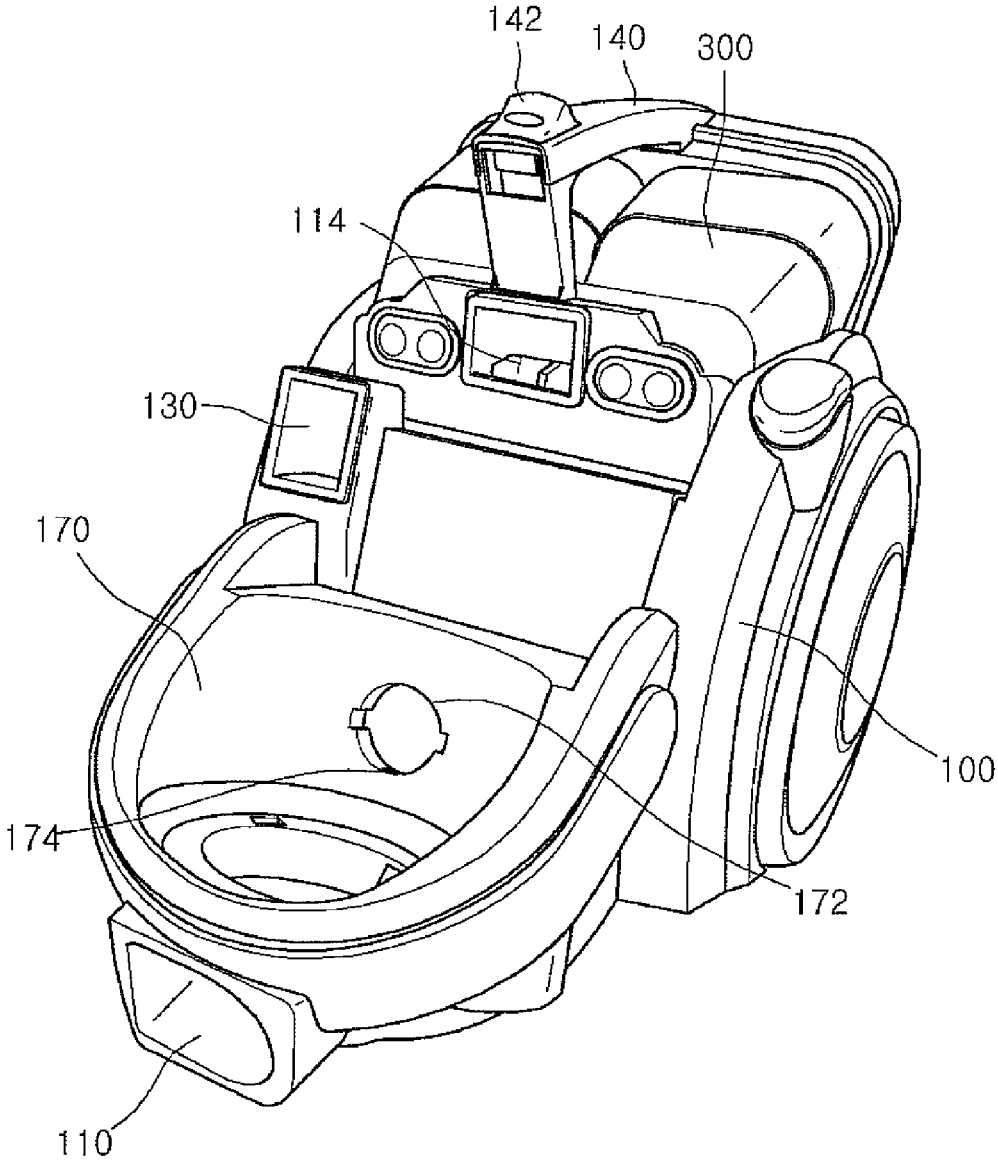
FIG. 2 is a front, perspective view of the vacuum cleaner of FIG. 1, when a dust collection device is separated from the vacuum cleaner.
Figure 3:
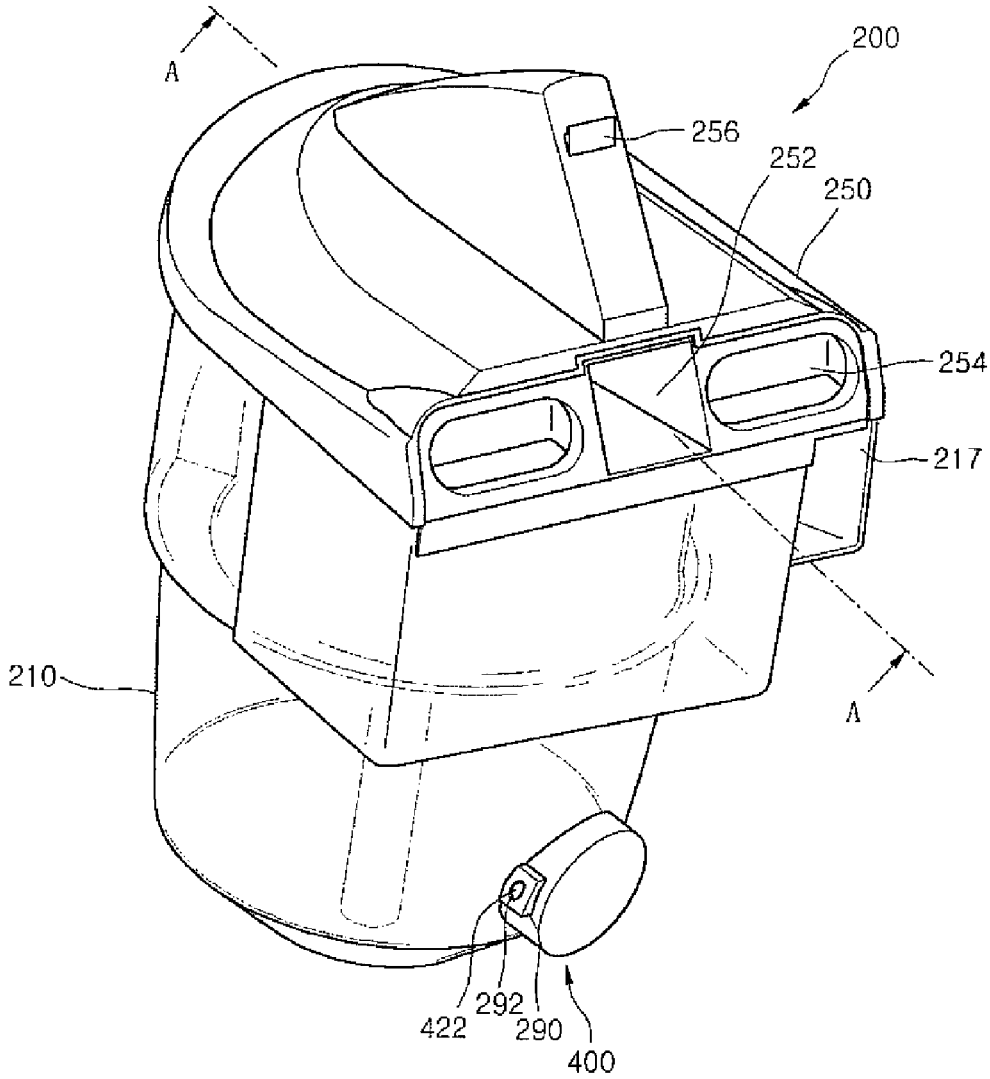
FIG. 3 is a rear, perspective view of a dust collection device of the vacuum cleaner of FIG. 1.

FIG. 1 is a front, perspective view of a vacuum cleaner according to an embodiment. FIG. 2 is a front, perspective view of the vacuum cleaner of FIG. 1, when a dust collection device is separated. FIG. 3 is a rear, perspective view of a dust collection device of the vacuum cleaner of FIG. 1.

Referring to FIGS. 1 through 3, a vacuum cleaner 10 according to this embodiment may include a main body 100, in which a suction motor (not shown) that generates a suction force is provided, and a dust separating device that separates dust from the air. The vacuum cleaner 10 may further include a suction nozzle (not shown) that sucks air containing dust into the vacuum cleaner and an extension pipe (not shown) that connects the suction nozzle to the main body 100. Since a basic structure of the suction nozzle and the connection pipe are well known in the art, a detailed description thereof has been omitted.

A main body inlet 110, through which air containing dust sucked in through the suction nozzle 20 may be introduced into the main body 100, may be formed on a front, lower end of the main body 100. A main body outlet (not shown), through which the air from which dust has been separated may be discharged to outside of the vacuum cleaner, may be formed on a side of the main body 100. A main body handle device 140 may be formed on a top of the main body 100.

A dust separation device may include a dust collection device 200 having a first cyclone device 230, which will be described later, that primarily separates the dust from the air and a second cyclone device 300 that further separates the dust from the air from which the dust was primarily separated by the first cyclone device. The second cyclone device 300 may be provided in the main body 100.

The dust collection device 200 may be detachably mounted on a dust collection device mounting portion 170 formed on a front portion of the main body 100. A mounting/dismounting lever 142 may be provided on the main body handle device 140 and the dust collection device 200 may be provided with a hook step 256 that may be selectively engaged with the mounting/dismounting lever 142.

That is, a dust storing portion formed in a dust collection container 210 may include a first dust storing section 214, in which the dust separated by the first cyclone device 230 may be stored, and a second dust storing section, in which the dust separated by the second cyclone device 300 may be stored.

The dust collection device 200 may be designed to maximize a dust collection volume thereof. Therefore, the vacuum cleaner of this embodiment may include a compression structure that minimizes an amount of dust stored in the dust collection device 200.

Figure 4:
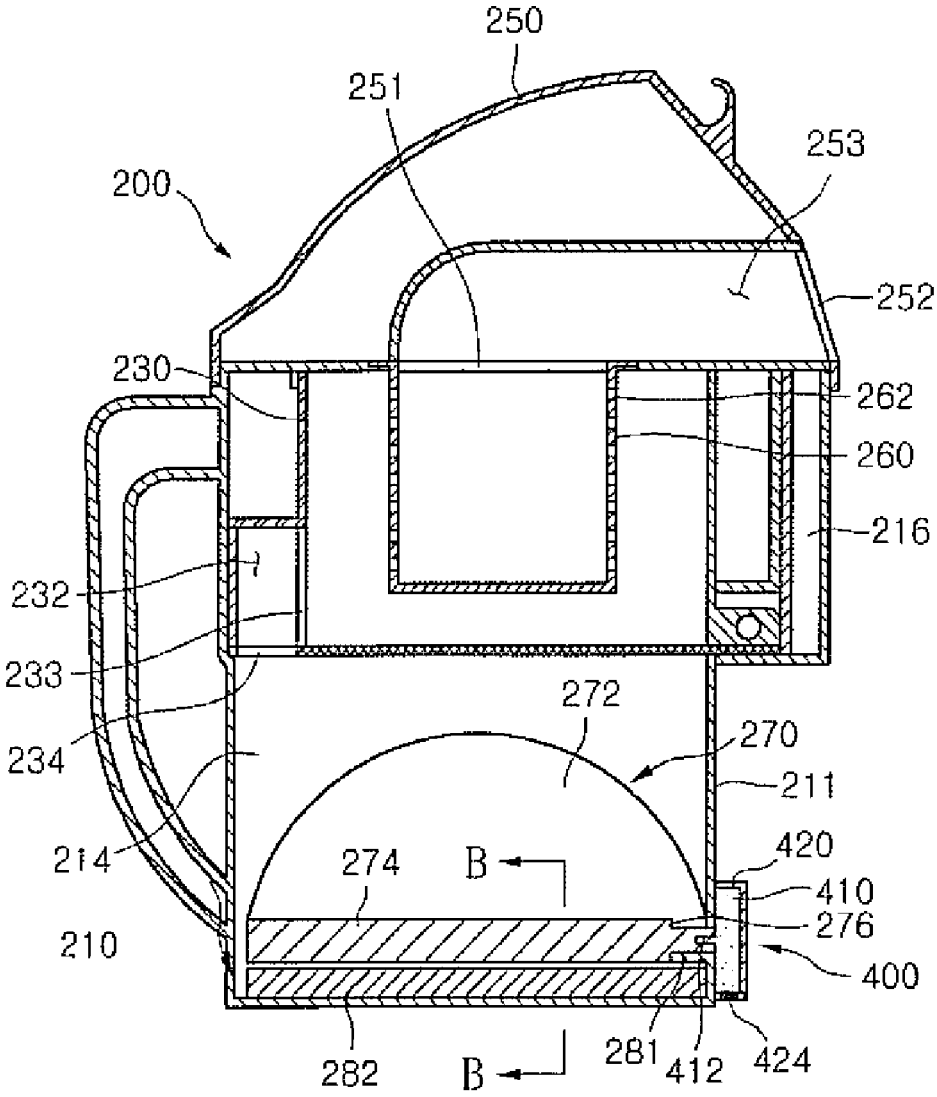
FIG. 4 is a sectional view taken along line A-A of FIG. 3.
Figure 5:
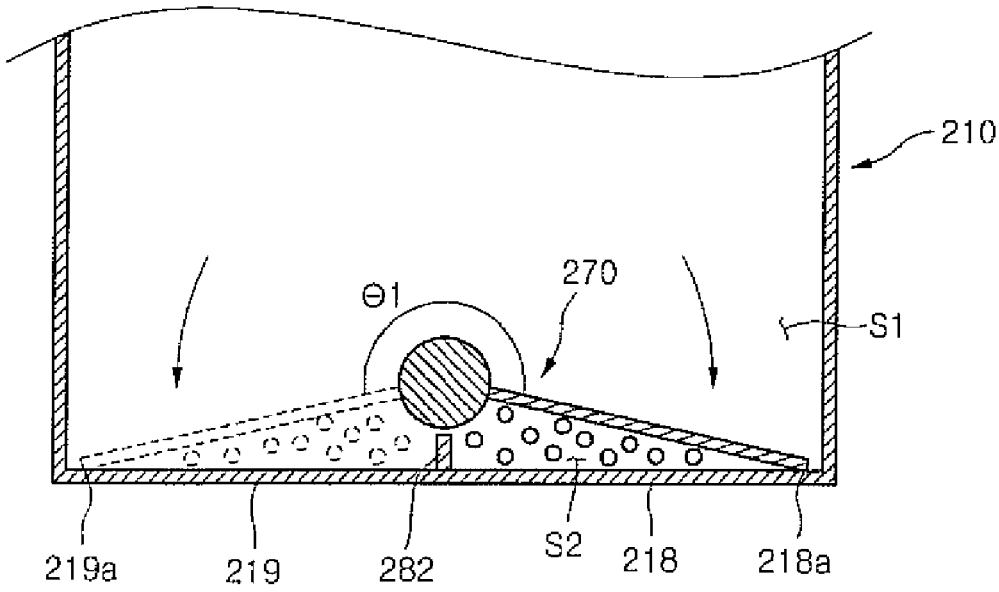
FIG. 5 is a sectional view taken along line B-B of FIG. 3.

FIG. 4 is a sectional view taken along line A-A of FIG. 3, and FIG. 5 is a sectional view taken along line B-B of FIG. 3. Referring to FIGS. 2 to 4, the dust collection device 200 of this embodiment may include a dust collection container 210 that defines an exterior thereof, the first cyclone device 230, which may be selectively received in the dust collection container 210 to separate the dust from the air, and a cover member 250 that selectively opens and closes a top of the dust collection container 210.

In more detail, the dust collection container 210 may have a lower portion that is formed in an approximately cylindrical shape and may define a dust storing portion that stores the dust separated by the first and second cyclone devices 230 and 300. The dust storing portion may include a first dust storing section 214, in which the dust separated in the first cyclone device 230 may be stored, and a second dust storing section 216, in which the dust separated in the second cyclone device 300 may be stored.

The dust collection container 210 may include a first wall 211 that defines the first dust storing section 214 and a second wall 212 that defines the second dust storing section 216 by association with the first wall 211. That is, the second wall 212 may be designed to enclose a portion of an outer side of the first wail 211. Therefore, the second dust storing section 216 may be formed at an outer side of the first dust storing section 214.

The dust collection container 210 may have an open top, through which the dust may be discharged to empty the dust collection container 210, and the cover member 250 may be detachably coupled to the top of the dust collection container 210. The dust collection container 210 may be coupled to a lower portion of the cover member 250 so that it may be separated together with the first cyclone device 230 when the dust stored in the dust collection container 210 is discharged.

The first cyclone device 230 may be provided with a dust guide passage 232 along which the dust separated from the air may be effectively discharged to the first dust storing device 214. The dust guide passage 232 may guide the dust in a tangential direction and direct the dust downward. An inlet 233 of the dust guide passage 232 may be formed on a side surface of the first cyclone device 230 and an outlet 234 may be formed on a bottom of the first cyclone device 230.

As described above, the cover member 250 may be detachably coupled to an upper side of the dust collection container 210. The cover member 250 may simultaneously open and close the first and second dust storing sections 214 and 216.

An air outlet 251, through which the air from which the dust may be separated in the first cyclone device 230 may be discharged, may be formed on a bottom of the cover member 250. A filter member 260 may be provided at an outer circumference of the air outlet 251 with a plurality of through holes 262, each having a predetermined size, and may be coupled to an under surface of the cover member 250. Therefore, the air in the first cyclone device 230 may be discharged through the air outlet 251 via the filter member 260.

A passage 253 that directs the air of the first cyclone device 230 toward the first air outlet 252 may be formed in the cover member 250. That is, the passage 253 may function to connect the air outlet 251 to the first air outlet 252.

Meanwhile, a compression member 270 that compresses the dust stored in the first dust storing section 214 may be provided in the dust collection container 210, and a driving device or driver 400 that rotates the compression member 270 may be coupled to an outer wall of the dust collection container 210.

The compression member 270 may be coupled to a sidewall of the dust collection container 210. A seating rib 281, on which a rotational shaft 274 that defines a rotational axis of the compression member 270 may be disposed, may be formed on an inner surface of the dust collection container 210. The seating rib 281 may extend from the sidewall of the dust collection container 210 toward a center of the dust collection container 210. Further, the seating rib 281 may be formed in a substantially semicircular shape. The rotational shaft 274 may be provided with a seating groove 276, in which the seating rib 281 may be inserted.

An axis of the rotational shaft 274 of the compression member 270 may be inclined relative to the sidewall of the dust collection container 210. More particularly, the axis may extend substantially perpendicular to the sidewall of the dust collection container 210. That is, the rotational shaft 274 of the compression member 270 may be provided in the dust collection container 210 and may be disposed or extend in a horizontal direction. Therefore, the compression member 270 may vertically rotate. In addition, the rotational shaft 274 may penetrate the sidewall of the dust collection container 210 in a state in which it sits on the seating rib 281. Further, a motor shaft 412 of a driving motor 410 may be coupled to the rotational shaft 274 that penetrates the sidewall of the dust collection container 210.

The compression member 270 may include a compression plate 272 formed in a substantially semicircular shape. That is, since the dust collection container 210 may be formed in an approximately cylindrical shape, the compression of the dust by the compression plate 272 may be effectively realized by forming the compression plate 272 in the substantially semicircular shape.

The shape of the compression plate 272 may vary in accordance with a horizontal section of the dust collection container 210. For example, when the horizontal section of the dust collection container 210 is substantially rectangular, the compression plate 272 may be also formed in a substantially rectangular shape.

A dividing portion 282 that divides an inner space of the first dust storing section 214 into two sections may protrude from a bottom surface of the dust collection container 210. The dividing portion 282 may be located under the rotational shaft 274. Therefore, the bottom surface of the dust collection container 210 may be divided into first and second bottom surfaces 218 and 219 by the dividing portion 282. That is, the first dust storing section 214 may be divided into two sections by the dividing portion 282.

The driving device 400 may include a motor housing 420 coupled to the sidewall of the dust collection container 210 and a driving motor 410 received in the motor housing 420. In addition, the driving motor 410 may be coupled to the rotational shaft 274 when the driving device 400 is coupled to the dust collection container 210. Further, the motor housing 420 may be provided with a terminal portion 424 that supplies power to the driving motor 410.

The dust collection device mounting portion 170 may be provided with a receiving portion 172 that receives the driving device 400 in a state in which dust collection device 200 is mounted on the dust collection device mounting portion 170. Further, the receiving portion 172 may be provided with a power supply terminal 174 that selectively contacts the terminal portion 424. Therefore, when the dust collection device 200 is mounted on the dust collection device mounting portion 170, the terminal portion 424 may contact the power supply terminal 174 so that the power may be supplied from the main body 100 to the driving motor 410.

The motor housing 420 may be coupled to a coupling rib 290 formed on the sidewall of the dust collection container 210 while receiving the driving motor 410. A coupling protrusion 422 may be formed on an outer side of the motor housing 420. The coupling rib 290 may be provided with an insertion hole 292, in which the coupling protrusion 422 may be selectively inserted.

The driving motor 410 may be a reversible motor. That is, the driving motor 410 may be a bidirectional motor. Accordingly, the compression member 270 may rotate in forward and reverse directions. As the compression member rotates in the forward and reverse directions, the dust may be compressed and accumulated on the first and second bottom surfaces 218 and 219.

As described above, since the driving motor 410 may rotate in the forward and reverse directions, a synchronous motor may be used as the driving motor 410. The synchronous motor may rotate in the forward and reverse directions. When the load applied to the motor is greater than a predetermined value as the motor rotates in a first direction, the motor is designed to rotate in a second direction.

The load applied to the motor may be a torque that is generated as the compression member 270 compresses the dust accumulated in the dust collection container 210, or on the first and second bottom surfaces 218 and 219 when there is no dust in the dust collection container. Therefore, when the torque reaches a predetermined value, the rotational direction of the motor changes.

Since synchronous motors are well known in the art, a detailed description thereof has been omitted herein. However, the technique for rotating the compression member 270 using the synchronous motor is one of the technical concepts of this embodiment. In order to effectively compress the dust, the driving motor 410 may be designed to continuously rotate the compression member 270 in the forward and reverse directions at an identical angle speed.

The following will describe a dust compression process in a dust collection device 200 structured as described above. Referring to FIG. 5, when power is applied to the driving motor 410 in a state in which the dust collection device 200 is mounted on the main body 100, the driving motor 410 rotates in a first direction. Then, the compression member 270 connected to the driving motor 410 also rotates in the first direction. Therefore, a gap between a first surface of the compression member and the first bottom surface 218 may be reduced, and thus, the dust accumulated on the first bottom surface 218 compressed.

Further, when the torque applied to the compression member 270 is greater than a predetermined value, for example, when the compression member contacts the first bottom surface 218, the driving motor 410 may rotate in a second direction, and thus, the compression member may rotate in the second direction. Therefore, a gap between a second surface of the compression member 270 and the second bottom surface 219 may be reduced, and thus, the dust accumulated on the second bottom surface 219 compressed. In addition, when the torque applied to the compression member 270 is higher than a predetermined value, for example, when the compression member 270 contacts the second bottom surface 219, the driving motor 410 rotates in the first direction, and thus, the compression member 270 also rotates in the first direction.

A portion of the first bottom surface 218 contacting the compression member 270 may be referred to as a "first contacting portion" 218*a* and a portion of the second bottom surface 218 contacting the compression member 270 may be referred to as a "second contacting portion" 219*a*. The compression member 270 may rotate about the rotational axis (rotational shaft) within an angle range θ1 between the first contacting portion 218*a* and the second contacting portion 219*a*. A space corresponding to the angle range θ1 in the first dust storing section 214 may be referred to as a "first space" S1. On the other hand, the dust may be at least partly stored in a "second space" S2 corresponding to an angle range (360°−θ1). Since the second space S2 of the first dust storing section 214 is defined by the dividing portion 282, mixing of the dust accumulated (compressed) on the first bottom surface 218 and dust accumulated (compressed) on the second bottom surface 219 during the compression of the dust by the compression member 270 may be prevented.

According to this embodiment, since the dust stored in the dust collection container may be compressed by the compression member, a dust collection volume of the dust collection container may be increased. In addition, since the rotational direction of the compression member changes as the compression member contacts the dust collection container, the dust stored in the dust collection container may be fully compressed.

Further, since the dust in the dust collection container remains in a compressed state, dispersion of the dust may be minimized during a container emptying process. In addition, since the driving device may be detachably coupled to the dust collection container, the driving device of the dust collection container may be separated from the dust collection device, and thus, inflow of water into the driving device may be prevented.

Figure 6:
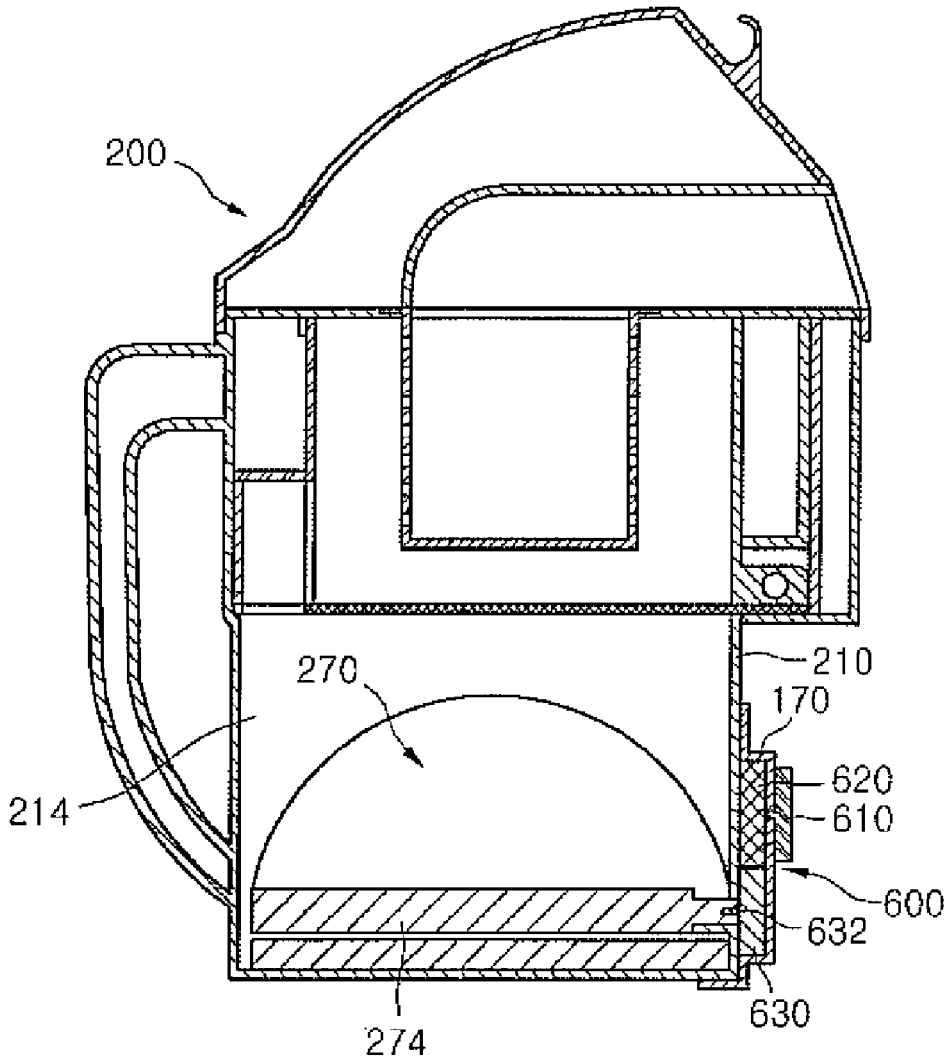
FIG. 6 is a sectional view of a cleaner main body on which a dust collection device is mounted according to another embodiment.

FIG. 6 is a sectional view illustrating a cleaner main body on which a dust collection device may be mounted according to another embodiment. This embodiment is substantially the same as the embodiment of FIGS. 1-5, except for the structure of a driving device, and repetitive disclosure has been omitted.

Referring to FIG. 6, a driving device or driver 600 of this embodiment may include a driving motor 610 provided in a main body 100 and a power transmission device that transfers torque of the driving motor 610 to a compression member 270. The driving motor may be located inside a dust collection device mounting portion 170. The power transmission device may include a driving gear 620 coupled to a shaft of the driving motor 610 and a driven gear 630 coupled to a rotational shaft of the compression member 270.

The driving gear 620 may be exposed out of the dust collection device mounting portion 170. A shaft of the driven gear 630 may penetrate a sidewall of a dust collection container 210 and may be coupled to the rotational shaft 274 of the compression member 270.

When a dust collection device 200 is mounted on the dust collection device mounting portion 170, the driven gear 630 may be engaged with the driving gear 620 to enable a compression member 270 to rotate. On the other hand, when the dust collection device 200 is separated from the dust collection device mounting portion 170, the driven gear 630 may be disengaged from the driving gear 620. According to this embodiment, since the driving motor is provided in the main body of the cleaner, a weight of the dust collection device may be reduced.

Figure 7:
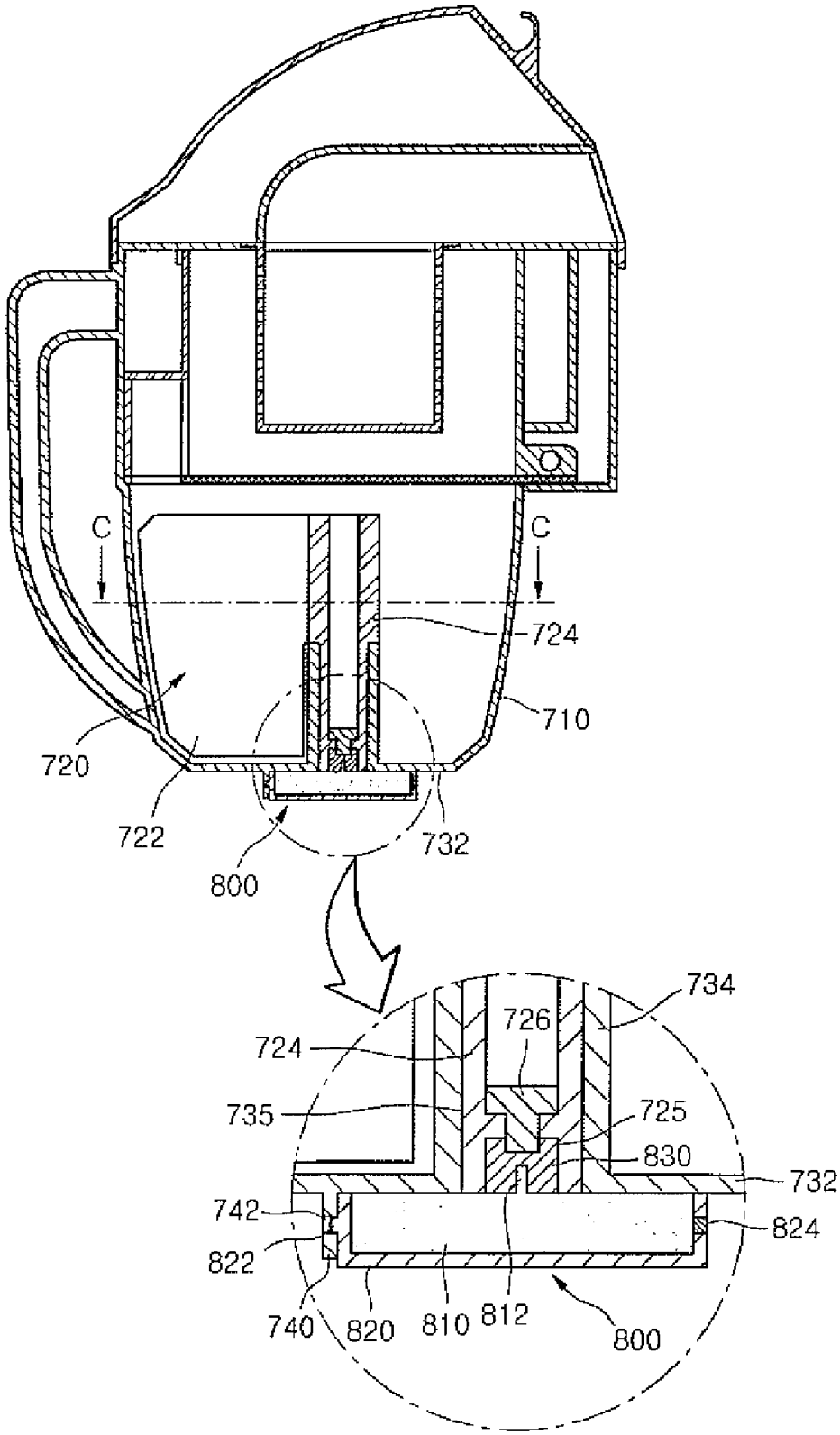
FIG. 7 is a vertical-sectional view of a dust collection device according to another embodiment.
Figure 8:
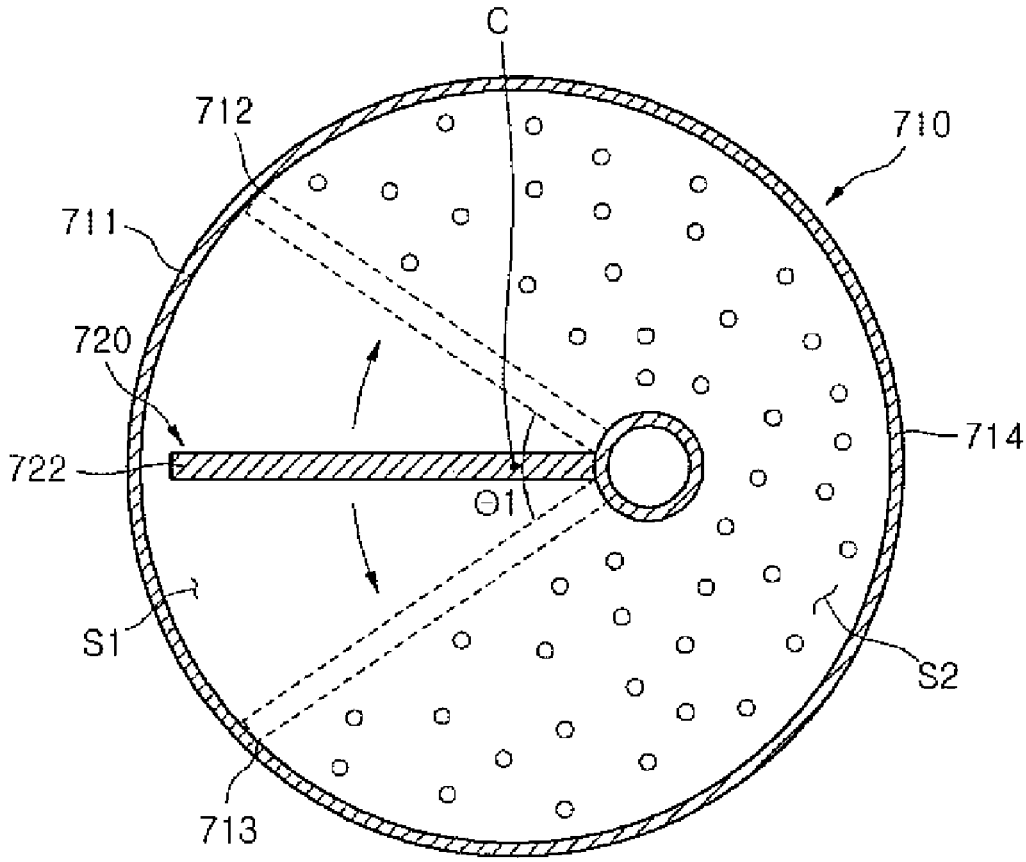
FIG. 8 is a sectional view taken along line C-C of FIG. 7.

FIG. 7 is a vertical-sectional view of a dust collection device according to another embodiment. FIG. 8 is a sectional view taken along line C-C of FIG. 7. This embodiment is substantially the same as the embodiment of FIGS. 1-5, except for a coupling location of the compression member and a coupling location of the driving device, and repetitive disclosure has been omitted.

Referring to FIGS. 7 and 8, a compression member 720 may be oriented in a direction intersecting a bottom surface 732 of the dust collection container 710. That is, a rotational shaft 724 of the compression member 720 may intersect the bottom surface 732 of the dust collection container 710. In this embodiment, a driving device or driver 800 may be disposed under the dust collection container 710 and may be coupled to an undersurface of the bottom surface 732 of the dust collection container 710.

In more detail, a horizontal section of a lower portion of the dust collection container 710 may be substantially formed in a circular shape. A rotational axis of the compression member 720 may be spaced apart from a center of the undersurface of the bottom surface 732 of the dust collection container 710. As shown in FIG. 8, a horizontal length of a compression plate 722 of a compression member 720 may be greater than a distance between a bottom center C of the dust collection container 710 and a sidewall of the dust collection container 710.

A fixing shaft 734 that fixes the rotational shaft 724 may be formed on the bottom surface 732 of the dust collection container 710. The fixing shaft 734 may protrude from the bottom surface 732 of the dust collection container 710 and may be provided with a hollow portion 735 that is formed in an axial direction to fix the rotational shaft 724. A portion of the rotational shaft 724 may be inserted into the hollow portion 735 from an upper side of the fixing shaft 734.

The driving device 800 may be separately coupled to the bottom surface 732 of the dust collection container 710 when the driving device 800 is coupled to the dust collection container 710 and connected to the compression member 720. The driving device 800 may include a driving motor 810 that generates torque, a driving gear 830 that effectively transfers the torque of the driving motor 810 to the compression member 720, and a motor housing 820 that receives the driving motor 810.

The motor housing 820 may be coupled to a coupling rib 740 formed on the undersurface of the bottom surface 732 of the dust collection container 710 in a state in which the driving motor 810 is received in the motor housing 820. A coupling protrusion 822 may be formed on an outer surface of the motor housing 820 and a protrusion insertion hole 722, in which the coupling protrusion 822 may be selectively inserted, may be formed on the coupling rib 740.

The driving gear 830 may be coupled to a lower portion of the rotational shaft 724 and may be selectively coupled to a shaft 812 of the driving motor 810. Further, a gear coupling portion 725 formed in a shape corresponding to the driving gear 830 may be formed at a bottom of the rotational shaft 724. A coupling member 726 may be coupled to the rotational shaft 724 and the driving gear 830 in a state in which the rotational shaft 724 is coupled to the driving gear 830.

The motor housing 820 may include a terminal portion 824 electrically connected to the driving motor 810. When the dust collection device 200 is mounted on the dust collection device mounting portion, the terminal portion 824 may be connected to a power supply terminal (not shown) formed on the dust collection device mounting portion.

The following describes a dust compression process according to an embodiment.

Referring to FIG. 8, when power is applied to the driving motor 810, the driving motor 810 may rotate in a first direction. Then, the compression member 720 connected to the driving motor 810 may also rotate in the first direction. Since the horizontal length of the compression plate 722 is greater than the distance between the bottom center C of the dust collection container 710 and the sidewall of the dust collection container 710, the compression member 270 may contact the first contacting portion 712 of the dust collection container 710 while rotating in the first direction. Then, when the torque applied to the compression member 720 increases above a preset value, the driving motor 810 may rotate in a second direction. Therefore, the compression member 720 may also rotate in the second direction.

When the compression member 720 rotates by a predetermined angle in the second direction, the compression member 720 may contact a second contacting portion 713 of the dust collection container 710. Then, when the torque applied to the compression member 720 increases above a preset value, the driving motor 810 may rotate in the first direction, and thus, the compression member 720 may also rotate in the first direction.

That is, in this embodiment, the compression member 720 may rotate about its central axis within an angle range θ1 defined between the first contacting portion 712 and the second contacting portion 713. A space corresponding to the angle range θ1 in the first dust collection container 710 may be referred to as a "first space" S1. Therefore, the compression member 720 may rotate in the first space S1. On the other hand, the dust may be at least partly stored in a "second space" S2 corresponding to an angle range (360°−θ1).

Since the horizontal length of the compression plate 722 is greater than a distance between the bottom center C of the dust collection container 710 and the sidewall of the dust collection container 710, a distance between the rotational axis of the compression member 720 and a point on an outer wall of the dust collection container 710 that defines the first space S1 is designed to be greater than a distance between the rotational axis of the compression member 720 and a point on an outer wall 714 of the dust collection container 710 defining the second space S2.

Figure 9:
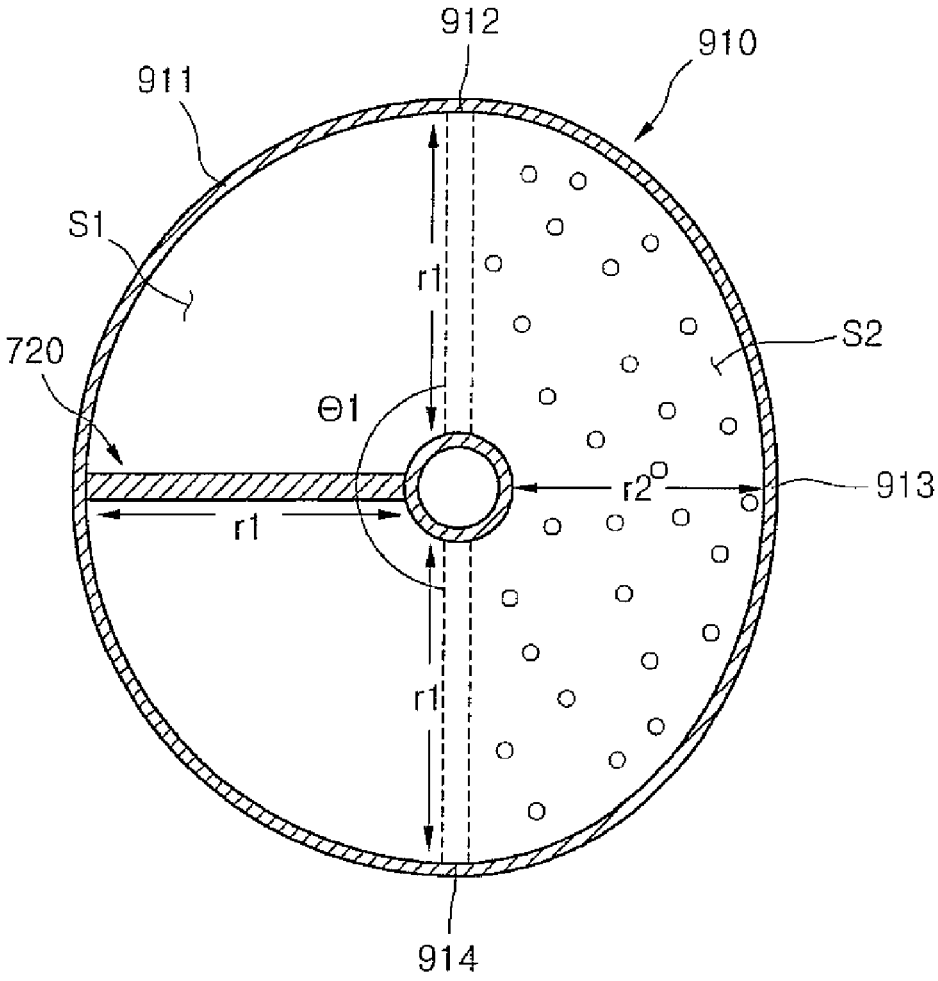
FIG. 9 is a horizontal-sectional view of a dust collection container according to another embodiment.
Figure 10:
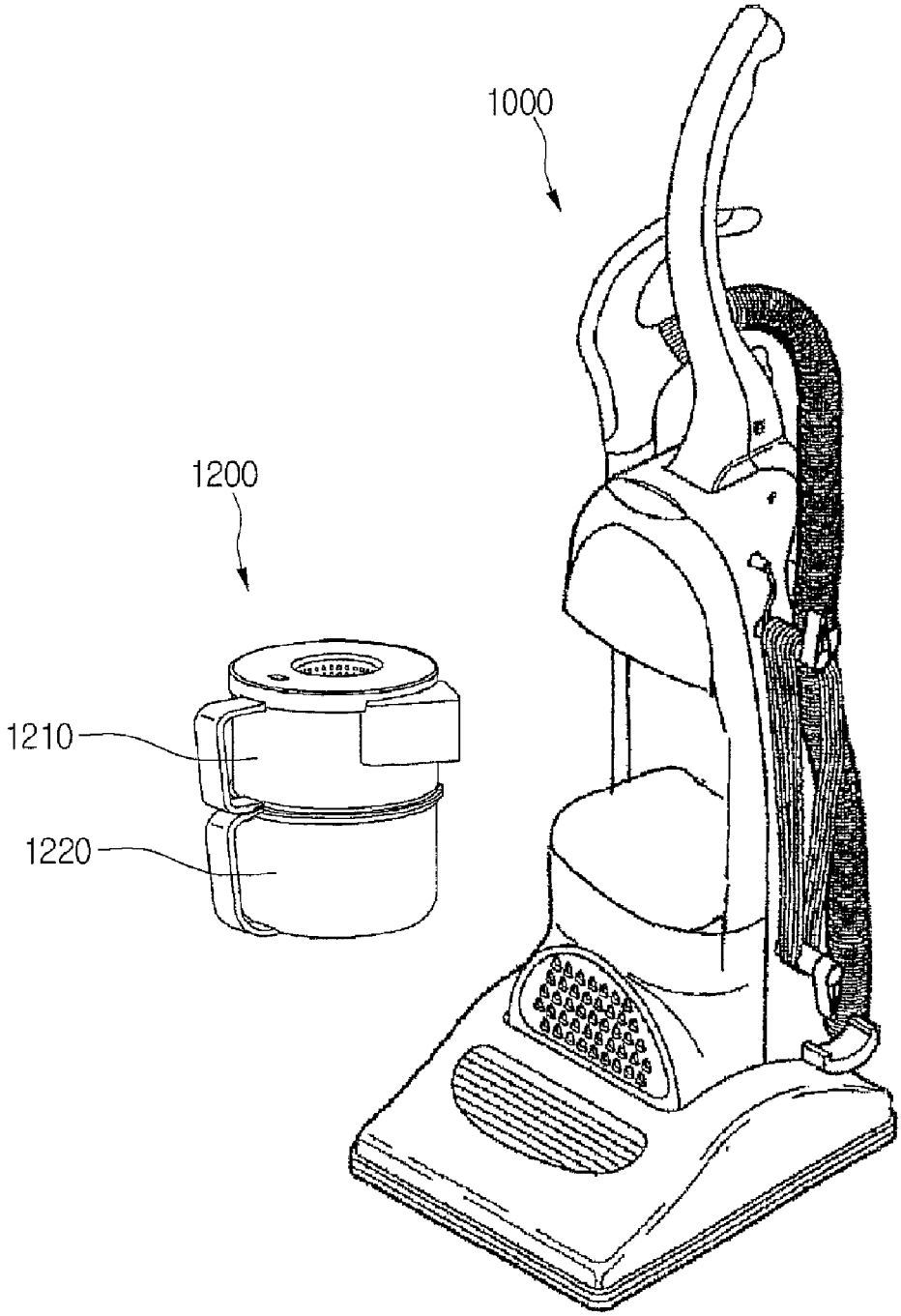
FIG. 10 is a front, perspective view of an upright vacuum according to an embodiment.

FIG. 9 is a horizontal-sectional view of a dust collection container according to another embodiment. This embodiment is substantially the same as the embodiment of FIGS. 7-8, except for a shape of a dust collection container, and repetitive disclosure has been omitted.

Referring to FIG. 9, a horizontal section of a dust collection container 910 may not be circular. A sidewall of the dust collection container 910 may be divided into first and second sidewalls 911 and 913. The first sidewall 911 may have a different curvature from the second sidewall 913. More particularly, a curvature radius $r_1$ of the first sidewall 911 may be greater than a curvature radius $r_2$ of the second sidewall 913, such that $r_2<r_1$. Therefore, a boundary portion between the first and second sidewalls 911 and 913 may function as contacting portions 912 and 914 which/where the compression member 720 contacts while rotating.

Further, the compression member 720 may rotate about its rotational axis within an angle range θ1 defined between the contacting portions 912 and 914. A space corresponding to the angle range θ1 in the first dust collection container 710 may be referred to as a "first space" S1. The dust may be at least partly stored in a "second space" S2 corresponding to an angle range (360°−θ1).

Any of the embodiments disclosed herein may be employed in an upright vacuum cleaner, such as the vacuum cleaner 1000 shown in FIG. 20. Further, the dust separator 1210 may be contained within the dust collector body 1220 or the dust separator 1210 may be separately provided from the dust collector body 1220. More detailed explanations of upright vacuum cleaners are provided in U.S. Pat. Nos. 6,922,868 and 7,462,210, which are hereby incorporated by reference.

Embodiments disclosed herein provide a vacuum cleaner that is designed to increase a dust collection volume of a dust collection container by compressing dust stored in a dust collection device. Embodiments disclosed herein also provide a vacuum cleaner that may minimize dispersion of dust during an emptying process of a dust collection container storing the dust.

In one embodiment, a vacuum cleaner according to embodiments disclosed herein may include a dust collection container that stores dust, a compression member that is provided in the dust collection container and that is capable of rotating in first and second directions, and a driver that rotates the compression member. The compression member may rotate in a first space corresponding to a first angle range and at least a portion of the dust may be stored in a second space corresponding to a second angle range, for example, 360°—the first angle range.

According to the embodiments disclosed herein, since the dust stored in the dust collection container may be compressed by the compression member, an amount of dust that can be stored in the dust collection device may be maximized. In addition, since the compression member may automatically change its rotational direction upon contacting the dust collection container, the dust stored in the dust collection container may be fully compressed. Also, as the dust collection volume of the dust collection container may be maximized by the compression of the compression member, there may be no need to frequently empty the dust collection container. Further, since the dust may remain in a compressed state, dispersion of the dust may be prevented during an emptying process of the dust collection container.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a dust collection container that stores dust;

a compression member, which is provided in the dust collection container and which is configured to rotate in first and second directions; and a driver that rotates the compression member, wherein the compression member rotates in a first space corresponding to a first angle range and at least a portion of the dust is stored in a second space corresponding to a second angle range, wherein the dust collection container comprises a plurality of contacting portions that contacts the compression member as the compression member rotates, the plurality of the contacting portions forming an angle corresponding to the first angle range with respect to a rotational axis of the compression member.

2. The vacuum cleaner according to claim 1, wherein a rotational direction of the compression member changes when the compression member contacts one of the plurality of contacting portions.

3. The vacuum cleaner according to claim 2, wherein a rotational axis of the compression member intersects a bottom surface of the dust collection container.

4. The vacuum cleaner according to claim 3, wherein a curvature of an outer wall of the dust collection container, which defines the first space, is different from a curvature of an outer wall of the dust collection container, which defines the second space.

5. The vacuum cleaner according to claim 3, wherein a distance between the rotational axis of the compression member and a point on an outer wall of the dust collection container, which defines the first space, is different from a distance between the rotational axis of the compression member and a point on an outer wall of the dust collection container, which defines the second space.

6. The vacuum cleaner according to claim 3, wherein the driver is mounted on a bottom wall of the dust collection container.

7. The vacuum cleaner according to claim 3, further comprising a rotational shaft that defines a rotational axis of the compression member, wherein the rotational shaft intersects a sidewall of the dust collection container.

8. The vacuum cleaner according to claim 7, wherein the compression member comprise a substantially semi-circular shaped plate.

9. The vacuum cleaner according to claim 7, further comprising a dividing portion provided under the rotational shaft that divides a space of a dust storing portion into at least two sections.

10. The vacuum cleaner according to claim 9, wherein the dust collection container comprises at least first and second bottom surfaces that are defined based on the rotational shaft, and wherein the compression member compresses dust stored between a first surface of the compression member and the first bottom surface when rotating in the first direction, and compresses dust stored between a second surface of the compression member and the second bottom surface when rotating in the second direction.

11. The vacuum cleaner according to claim 7, wherein the driver is mounted on the sidewall of the dust collection container.

12. The vacuum cleaner according to claim 1, wherein the driver is detachably coupled to the dust collection container.

13. The vacuum cleaner according to claim 12, further comprising a cleaner main body to which the dust collection container is detachably coupled, wherein the cleaner main body includes a power supply terminal that is selectively coupled to the driver.

14. The vacuum cleaner according to claim 1, wherein the driver comprises a reversible motor.

15. The vacuum cleaner according to claim 14, further comprising a cleaner main body to which the dust collection container is detachably coupled, wherein the driving motor is provided in the cleaner main body and the compression member is configured to be rotated by the driving motor when the dust collection device is mounted on the cleaner main body.

16. The vacuum cleaner according to claim 15, further comprising a power transmission device that transfers power from the driving motor to the compression member.

17. The vacuum cleaner according to claim 16, wherein the power transmission device comprises at least one gear.

* * * * *